US009234286B2

(12) United States Patent
Wedde et al.

(10) Patent No.: US 9,234,286 B2
(45) Date of Patent: Jan. 12, 2016

(54) RECYCLED POT GAS POT DISTRIBUTION

(71) Applicant: ALSTOM Technology Ltd, Baden (CH)

(72) Inventors: Geir Wedde, Oslo (NO); Odd E. Bjarno, Oslo (NO); Anders K. Sorhuus, Ski (NO)

(73) Assignee: ALSTOM Technology Ltd, Baden (CH)

( * ) Notice: Subject to any disclaimer, the term of this patent is extended or adjusted under 35 U.S.C. 154(b) by 201 days.

(21) Appl. No.: 13/851,495

(22) Filed: Mar. 27, 2013

(65) Prior Publication Data

US 2013/0292258 A1 Nov. 7, 2013

Related U.S. Application Data

(60) Provisional application No. 61/642,555, filed on May 4, 2012.

(51) Int. Cl.
*C25C 3/22* (2006.01)
*C25C 3/08* (2006.01)

(52) U.S. Cl.
CPC .... *C25C 3/22* (2013.01); *C25C 3/08* (2013.01)

(58) Field of Classification Search
USPC ..... 205/391
See application file for complete search history.

(56) References Cited

U.S. PATENT DOCUMENTS

| | | | | |
|---|---|---|---|---|
| 3,664,935 | A * | 5/1972 | Johnson | 205/393 |
| 3,904,494 | A * | 9/1975 | Jacobs et al. | 205/349 |
| 2004/0194513 | A1 * | 10/2004 | Giacobbe et al. | 65/512 |
| 2006/0172176 | A1 * | 8/2006 | MacBain et al. | 429/38 |
| 2009/0159434 | A1 | 6/2009 | Girault et al. | |
| 2013/0048508 | A1 * | 2/2013 | Wedde | 205/391 |

FOREIGN PATENT DOCUMENTS

| | | | | |
|---|---|---|---|---|
| CN | 101435089 | A * | 5/2009 | C25C 3/22 |
| RU | 2009128041 | A | 1/2011 | |
| WO | WO 2008/113496 | A1 * | 9/2008 | C25C 3/22 |
| WO | WO 2011/089497 | A1 * | 7/2011 | C25C 3/22 |
| WO | 2011/131901 | A1 | 10/2011 | |

OTHER PUBLICATIONS

Office action issued from Australian Patent Office dated Dec. 8, 2014 for AU Application No. 2013205689.

Decision on Grant issued from Russian Patent Office dated Dec. 22, 2014 for RU Application No. 2013120533.

* cited by examiner

*Primary Examiner* — Harry D Wilkins, III

(57) ABSTRACT

An aluminum production electrolytic cell (14) comprises a bath (20) with bath contents (18), at least one cathode electrode (22) in contact with said contents (18), at least one anode electrode (16) in contact with said contents (18), and a hood (36), defining interior area (36*a*), covering at least a portion of said bath (20). The electrolytic cell (14) is equipped for effluent gases to be drawn from said interior area (36*a*). The electrolytic cell (14) also comprises at least one heat exchanger (74) for cooling at least a portion of the gases drawn from interior area (36*a*), prior to circulation thereof to interior area (36*a*) through at least one distribution device (90).

16 Claims, 4 Drawing Sheets

10
12
14
16
18
18a
20
22
26
28
30
32
34
36
36a
36b
38
40
42
44
46
48
50
54
56
58
60
62
64
66
68
70
72
74
76
78
80
82
84
88
90
92

RECYCLED POT GAS POT DISTRIBUTION

CROSS-REFERENCE TO RELATED APPLICATION

This application claims the benefit of U.S. Provisional Patent Application Ser. No. 61/642,555; filed on May 4, 2012, which is incorporated herein by reference in its entirety.

FIELD OF THE INVENTION

The present invention relates to a method of distributing recycled or "returned" gases to ventilate an aluminium production electrolytic cell comprising a bath with contents, at least one cathode electrode in contact with the bath contents, at least one anode electrode in contact with the bath contents, and a hood covering at least a portion of the bath.

The present invention also relates to a distribution device useful for distributing recycled or "returned" gases to an aluminium production electrolytic cell of the above referenced type.

BACKGROUND OF THE INVENTION

Aluminium is often produced by means of an electrolysis process using one or more aluminium production electrolytic cells. One such process is disclosed in US 2009/0159434. Such electrolytic cells typically comprise a bath for containing bath contents comprising fluoride-containing minerals on top of molten aluminium. The bath contents are in contact with cathode electrode blocks and anode electrode blocks. Aluminium oxide is supplied on regular intervals to the bath via openings at several positions along the center of the cell and between rows of anodes.

Aluminium so produced generates effluent gases, including hydrogen fluoride, sulphur dioxide, carbon dioxide and the like. These effluent gases must be removed and disposed of in an environmentally conscientious manner. Furthermore, heat generated by such an electrolysis process requires some manner of control to avoid problems associated with overheating of cell equipment located near the bath. As described in US 2009/0159434, one or more gas ducts may be used to draw effluent gases and dust particles away from a number of parallel electrolytic cells, and to remove generated heat away from the cells to cool cell equipment. To accomplish the same, a suction is generated in the gas ducts by means of a pressurized air supply device. This suction creates a flow of ambient ventilation air through the electrolytic cells. The flow of ambient ventilation air through the electrolytic cells cools the electrolytic cell equipment and draws the generated effluent gases and dust particles therefrom. Such a flow of pressurized air likewise creates a suitable gas flow through the electrolytic cells and the gas ducts to carry the generated effluent gases and dust particles to a gas treatment plant.

SUMMARY OF THE INVENTION

An object of the present invention is to provide a method of removing generated effluent gases and heat from an aluminium production electrolytic cell, using the heat from the generated effluent gases, and then recycling or returning the effluent gases back to the cell. Using the generated heat and recycling the effluent gases increase efficiency with respect to required capital investment and ongoing production operating costs than the method of the prior art.

The above-noted object is achieved by a method of recycling or returning generated effluent gases to an aluminium production electrolytic cell to ventilate the electrolytic cell, thereby reducing or eliminating the volume of ambient air required for cooling of the associated equipment. The method is useful for an aluminium production electrolytic cell comprising a bath, bath contents, at least one cathode electrode in contact with the bath contents, at least one anode electrode in contact with the bath contents, and a hood covering at least a portion of the bath. The subject method comprises:

drawing gases from an interior area of a hood covering at least a portion of an aluminium production electrolytic cell bath, cooling at least a portion of the gases to obtain cool gases, and returning at least a portion of the cool gases to the interior area of the hood using at least one distribution device positioned to reduce gas leakage at one or more gaps.

An advantage of the above-described method is that the volume of gas requiring cleaning is significantly less than that of the prior art since large volumes of ambient air are not added to the volume of generated effluent gases for purposes of cooling the same, prior to cleaning. Likewise, without the diluting effects of the large volumes of ambient air on the generated effluent gases, the gases drawn from the hood for cleaning carry higher concentrations of pollutants, such as hydrogen fluoride, sulphur dioxide, carbon dioxide, dust particles, and the like therein. Gases with higher concentrations of pollutants enable downstream equipment, such as for example a gas treatment unit, a carbon dioxide removal device, and the like, to work more efficiently. Furthermore, downstream equipment can be constructed to have smaller dimensions due to reduced capacity demands based on the reduced gas volumes requiring passage therethrough for cleaning. Such reductions in equipment size and capacity requirements reduce the required capital investment and ongoing operating costs of the overall production system.

A further advantage is that by removing, cooling and returning effluent gases to the interior area of the hood using at least one distribution device positioned to reduce leakage from at least one gap, or positioned to cool a particular "hot spot" inside the hood, the volume of ambient air required for electrolytic cell cooling is reduced or even eliminated. Reducing or eliminating the use of ambient air reduces the quantity of moisture transported by the gases to downstream equipment, such as for example, a downstream gas treatment unit. Moisture is known to strongly influence the rate of hard grade scale and crust formation on equipment in contact with the gases. Hence, with a reduced amount of moisture in the gases, the formation of scale and crust is reduced. Reducing the formation of scale, crust and deposits reduces the risk of equipment clogging, such as for example the clogging of heat exchangers and fans utilized for gas circulation.

Still a further advantage is that by removing, cooling and returning gases to the interior area of the hood using at least one distribution device positioned to reduce leakage from at least one gap, undesirable leakage of effluent gases from the hood is reduced or even eliminated. The at least one distribution device serves to return effluent gases to the interior area of the hood at a relatively high velocity. This relatively high velocity creates a suction around hood leakage points or "gaps", and alters pressure profiles within the interior area of the hood. Pressure profiles within the hood are altered by the returned effluent gases effectively cooling hot spots for more efficient system operation, as described in more detail below.

According to one embodiment, 10-80% of a total quantity of effluent gases drawn from the interior area of the hood are returned back to the hood interior area after cooling at least a portion of the gases to obtain cool gases. An advantage of this embodiment is that the hood and the electrolytic cell equipment located in the upper portion of the hood are sufficiently cooled by the cool gases. Likewise, a suitable increased concentration of pollutants within the gases is reached prior to cleaning of the gases in downstream equipment. The use of at least one distribution device and cool gases to cool production equipment reduces or eliminates the volume of ambient air required for such cooling. Still another advantage of this embodiment is that hot effluent gases drawn from the hood interior area for cooling provide high value heat to a heat exchanger, which may be used for other system processes.

According to another embodiment, the method further comprises cooling the full volume of gases drawn from the hood interior area by means of a first heat exchanger to produce cool gases. A portion of the cool gases then flow to a second heat exchanger for further cooling to produce cooler gases before at least a portion thereof is returned to the interior area of the hood via at least one distribution device. An advantage of this embodiment is that cooling the gases to a first temperature in a first heat exchanger is commercially feasible for the entire volume of gases drawn from the hood interior area. Such cooling of the gases by the first heat exchanger is suitable to adequately cool the gases for the temperature needs of downstream equipment, such as for example a gas treatment unit. Further cooling of a portion of the cool gases to a second lower temperature using a second heat exchanger to obtain cooler gases is particularly useful for gases returned to the hood interior area. Hence, the portion of the gases used to cool the interior area is efficiently cooled to a lower temperature than that of the portion of the gases that flow to downstream equipment, such as for example a gas treatment unit.

According to one embodiment, a cooling medium is first passed through the second heat exchanger, and then passed through the first heat exchanger. Hence, the portion of the gases returned to the interior area of the hood is first cooled in the first heat exchanger, and then in the second heat exchanger, while the cooling medium is first passed through second heat exchanger and then passed through first heat exchanger, making the cooling medium flow in a counter-current mode through the first and second heat exchangers to that of the gases. An advantage of this embodiment is that the cooling of the gases and the heating of the cooling medium through a counter-current mode of flow is very efficient.

According to another embodiment, the cooler gases to be returned to the hood interior area first flow through a gas treatment unit for removal of at least some hydrogen fluoride, and/or sulphur dioxide and/or dust particles, i.e., pollutants, present therein. An advantage of this embodiment is that the cooler gases are then comparably clean, i.e., relatively free of pollutant gases and/or dust particles, which may reduce the risk of corrosion and abrasion of equipment in the hood interior area, ducts, dampers, heat exchangers, fans and the like. Such cleaning of cooler gases may also reduce health risks associated with employee exposure to untreated "dirty" gases.

According to another embodiment, at least a portion of the cooler gases returned to the interior area of the hood are returned via at least one distribution device that creates a low pressure suction in the interior area of the hood at hood leakage points, typically at gaps around cell anodes. An advantage of this embodiment is that the suction created by the return of the cooler gases to the hood reduces gas leakage from the hood, possibly reducing health risks associated with employee exposure to untreated "dirty" gases.

According to one embodiment, at least a portion of the cooler gases is returned to an upper portion of the hood interior area via at least one distribution device. An advantage of this embodiment is that the risk of reaching excessive temperatures in the upper portion of the hood interior area due to the rise of hot gases is reduced, thus lessening the thermal load on electrolytic cell equipment arranged in the upper portion of the hood interior area.

According to one embodiment, at least a portion of the dust particles in the gases are removed therefrom prior to gas cooling in the first heat exchanger. An advantage of this embodiment is that it reduces abrasion and/or clogging of the heat exchanger or like cooling device or fan, by such dust particles.

A further object of the present invention is to provide an aluminium production electrolytic cell, which is more efficient with regard to treatment equipment operating costs than that of the prior art.

This object is achieved by means of an aluminium production electrolytic cell comprising a bath, bath contents, at least one cathode electrode in contact with the bath contents, at least one anode electrode in contact with the bath contents, a hood covering at least a portion of the bath, an interior area defined by said hood, at least one suction duct fluidly connected to the interior area for removing gases from said interior area, at least one heat exchanger for cooling at least a portion of the gases drawn from said interior area by means of the suction duct to produce cool gases, at least one return duct for returning at least a portion of the cool gases cooled by the heat exchanger to the hood interior area, and further comprising at least one distribution device in fluid communication with the at least one return duct for distributing returned cool gases at a suction creating velocity at a hood leakage point or gap and alter a pressure profile in the hood interior area.

An advantage of this aluminium production electrolytic cell is that at least a portion of the gases is cooled and reused, rather than discarded and replaced by adding cool, diluting, humid, ambient air as prior art equipment. Thus, with reduced gas volume since little or no ambient air is necessarily added to the generated effluent gases for purposes of cooling, cleaning equipment operates more efficiently, and equipment size and capacity requirements may be reduced.

According to one embodiment a fan is connected to the return duct to circulate gases to the hood interior area. An advantage of this embodiment is that an even and controllable flow of returned cool gases and/or cooler gases to the hood interior area is achieved.

According to one embodiment, the "at least one heat exchanger" is a first heat exchanger for cooling gases drawn from the hood interior area to obtain cool gases, and a second heat exchanger located in the return duct for further cooling the cool gases to obtain cooler gases, for return of the cooler gases to the hood interior area. An advantage of this embodiment is that cooling of the gases for return to the interior area can be combined with the cooling of the gases for cleaning treatment, for added efficiency.

According to one embodiment, a first pipe is provided for flow of a cooling medium from a cooling medium source to the second heat exchanger, a second pipe is provided for flow of the cooling medium from the second heat exchanger to the first heat exchanger, and a third pipe is provided for flow of the cooling medium from the first heat exchanger to a cooling medium recipient. An advantage of this embodiment is that the temperature of the cooling medium leaving the first heat exchanger can be relatively high, e.g., only about 10° to 30° C. lower than the temperature of the gases drawn from the hood interior area, thereby making such cooling medium useful for heating purposes in other parts of the process.

According to one embodiment, the return duct is a combined tending and return duct. As such, a return gas fan is arranged for forwarding returned cool gases and/or cooler gases through said combined tending and return duct to the hood interior area in a first operating mode. The combined tending and return duct is likewise arranged for transporting gases out from the hood interior area in a second operating mode. An advantage of this embodiment is that the same return duct can be utilized for returning cooled gases to the interior area during normal operation, and for drawing gases out from the hood interior area during electrolytic cell maintenance and tending, i.e., adding consumables to the cell, replacing spent carbon anodes, covering cells with recycled bath contents and aluminium oxide, and the like.

Further objects and features of the present invention will be apparent from the following detailed description and claims.

BRIEF DESCRIPTION OF THE DRAWINGS

The invention is described in more detail below with reference to the appended drawings in which.

DETAILED DESCRIPTION OF PREFERRED EMBODIMENTS

Figures 1, 4:
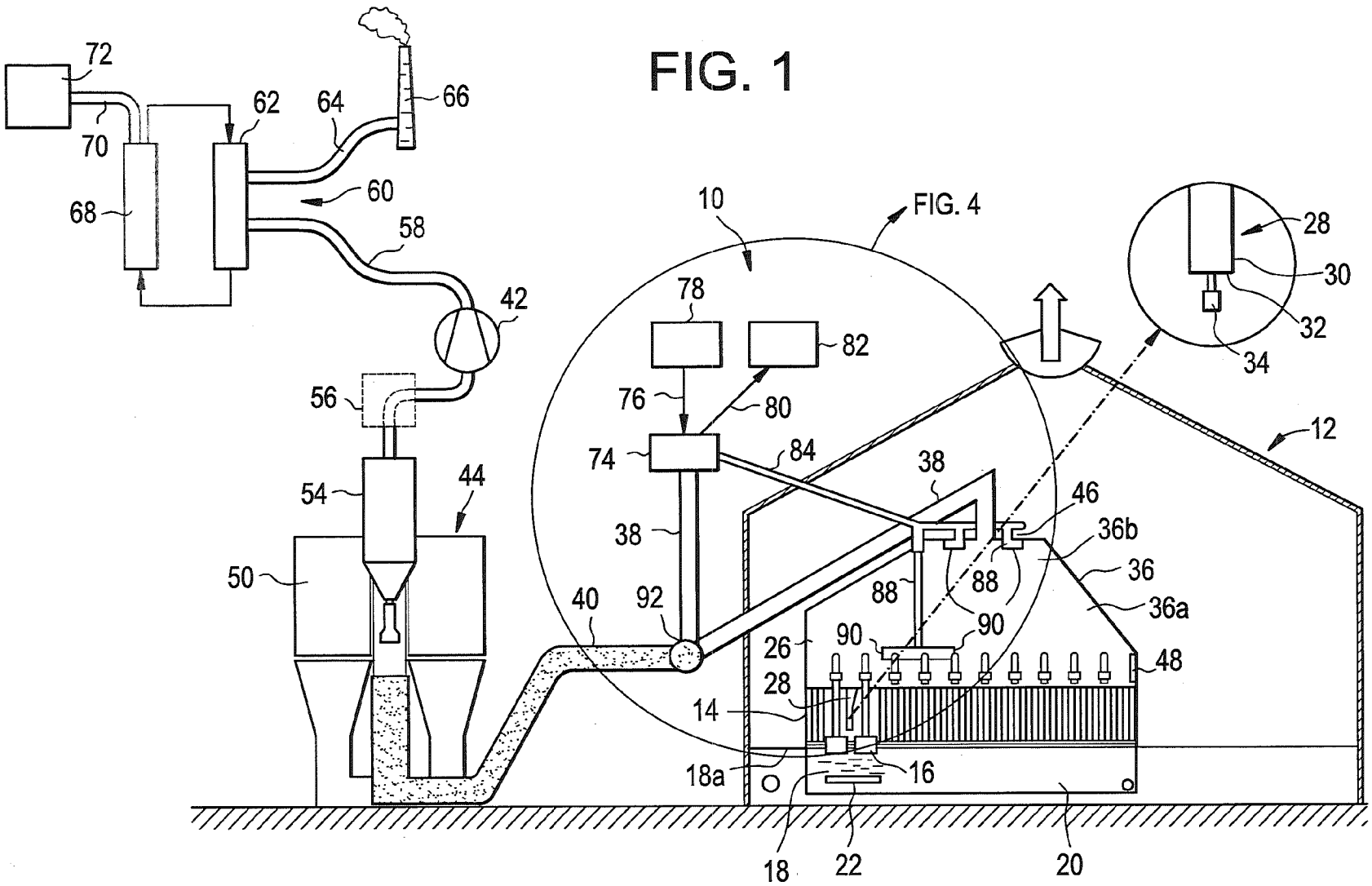
FIG. 1 is a schematic side cross sectional view of an aluminium production plant.
FIG. 4 is a schematic side cross sectional view of a portion of the aluminium production plant of FIG. 1 according to a second embodiment.

FIG. 1 is a schematic representation of an aluminium production plant 10. The main components of aluminium production plant 10 include an aluminium production electrolytic cell room 12 in which a number of aluminium production electrolytic cells 14 may be arranged. In FIG. 1, only one aluminium production electrolytic cell 14 is depicted for purposes of clarity and simplicity, but it will be appreciated that electrolytic cell room 12 may typically comprise 50 to 200 electrolytic cells 14. The aluminium production electrolytic cell 14 comprises a number of anode electrodes 16, typically six to thirty anode electrodes 16, typically arranged in two parallel rows extending along the length of electrolytic cell 14 and extending into contents 18 of bath 20. One or more cathode electrodes 22 are also located within bath 20. The process occurring in the electrolytic cell 14 may be the well-known Hall-Héroult process in which aluminium oxide is dissolved in a melt of fluorine containing minerals and electrolysed to form aluminium, hence the electrolytic cell 14 functions as an electrolysis cell. Powdered aluminium oxide is fed to electrolytic cell 14 from a hopper (not shown) integrated in a superstructure 26 of electrolytic cell 14. Powdered aluminium oxide is fed to the bath 20 by means of feeders 28. Each feeder 28 may be provided with a feeding pipe 30, a feed port 32 and a crust breaker 34 operative for forming an opening in a crust that often forms on a surface 18*a* of contents 18. An example of a crust breaker 34 is described in U.S. Pat. No. 5,045,168.

The electrolysis process occurring in electrolytic cell 14 generates large amounts of heat, dust particles, and effluent gases including but not limited to hydrogen fluoride, sulphur dioxide and carbon dioxide, i.e., pollutants. A hood 36 is arranged over at least a portion of bath 20 and defines interior area 36*a*. A suction duct 38 is fluidly connected to interior area 36*a* via a top 36*b* of hood 36. Similar suction ducts 38 of all parallel electrolytic cells 14 are fluidly connected to one collecting duct 40. A fan 42 draws gases from collecting duct 40 to a gas treatment unit 44. Fan 42 is preferably located downstream of gas treatment unit 44 to generate a negative pressure in the gas treatment unit 44. However, fan 42 could also, as an alternative, be located in collecting duct 40. Fan 42 creates via fluidly connected suction duct 38 and collecting duct 40, a suction in interior area 36*a* of hood 36. Some relatively small volume of ambient air could, as a result of this suction, be sucked into interior area 36*a* mainly via gaps or openings 46 between side wall doors 48, some of which have been removed in the illustration of FIG. 1 for purposes of clarity. The gases leaving interior area 36*a* via suction duct 38 comprise a relatively small volume of ambient air, effluent gases and dust particles generated in the aluminium production process.

In gas treatment unit 44, gases are mixed in contact reactor 50, with an absorbent, which may typically be aluminium oxide that is later utilized in the aluminium production process. Aluminium oxide reacts with some components of the gases, in particular, hydrogen fluoride, HF, and sulphur dioxide, $SO_2$. The particulate reaction products formed by the reaction of aluminium oxide with hydrogen fluoride and sulphur dioxide are then separated from the gases by fabric filter 54. In addition to removing hydrogen fluoride and sulphur dioxide from the gases, gas treatment unit 44 via fabric filter 54 also separates at least a portion of the dust particles that are entrained with the gases from interior area 36*a*. An example of a suitable gas treatment unit 44 is described in more detail in U.S. Pat. No. 5,885,539.

Optionally, gases flowing out of gas treatment unit 44 are further treated in a sulphur dioxide removal device 56. Sulphur dioxide removal device 56 removes most of the sulphur dioxide remaining in the gases after treatment in gas treatment unit 44. Sulphur dioxide removal device 56 may for example be a seawater scrubber, such as that disclosed in U.S. Pat. No. 5,484,535, a limestone wet scrubber, such as that disclosed in EP 0 162 536, or another such device that utilizes an alkaline absorption substance for removing sulphur dioxide from gases.

Optionally, gases flowing from gas treatment unit 44, or the sulphur dioxide removal device 56 as the case may be, pass through fluidly connected duct 58 to a carbon dioxide removal device 60, which removes at least some of the carbon dioxide from the gases. Carbon dioxide removal device 60 may be of any type suitable for removing carbon dioxide gas from effluent gases. An example of a suitable carbon dioxide removal device 60 is that which is equipped for a chilled ammonia process. In a chilled ammonia process, gases are in contact with, for example, ammonium carbonate and/or ammonium bicarbonate solution or slurry at a low temperature, such as 0° to 10° C., in an absorber 62. The solution or slurry selectively absorbs carbon dioxide gas from the gases. Hence, cleaned gases, containing mainly nitrogen gas and oxygen gas, flow from absorber 62 though fluidly connected clean gas duct 64 and are released to the atmosphere via fluidly connected stack 66. The spent ammonium carbonate and/or ammonium bicarbonate solution or slurry is transported from absorber 62 to a regenerator 68 in which the ammonium carbonate and/or ammonium bicarbonate solution or slurry is heated to a temperature of, for example, 50° to 150° C. to cause a release of the carbon dioxide in concentrated gas form. The regenerated ammonium carbonate and/or ammonium bicarbonate solution or slurry is then returned to the absorber 62. The concentrated carbon dioxide gas flows from regenerator 68 via fluidly connected duct 70 to a gas processing unit 72 in which the concentrated carbon dioxide gas is compressed. The compressed concentrated carbon dioxide may be disposed of, for example by being pumped into an old mine, or the like. An example of a carbon dioxide removal device 60 of the type described above is disclosed in US 2008/0072762. It will be appreciated that other carbon dioxide removal devices may also be utilized.

Figure 2:
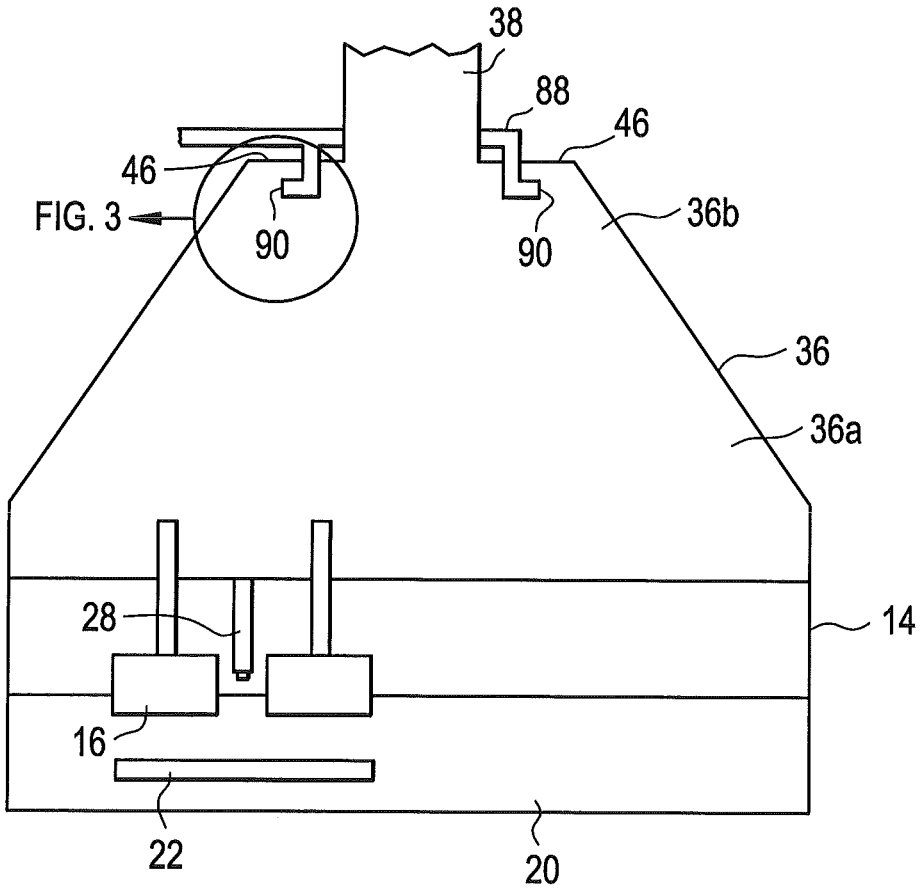
FIG. 2 is an enlarged schematic side cross sectional view of an aluminium production electrolytic cell according to a first embodiment.

FIG. 2 is an enlarged schematic side view of the aluminium production electrolytic cell 14. For purposes of clarity, only two anode electrodes 16 are depicted in FIG. 2. As disclosed hereinbefore with reference to FIG. 1, fan 42 draws vent gases from interior area 36*a* of the hood 36 into fluidly connected suction duct 38. As a result of the suction created by fan 42, effluent gases sucked from interior area 36*a* enter suction duct 38.

Again referring to FIG. 1, a first heat exchanger 74 is arranged in duct 38. A cooling medium, which is normally a cooling fluid, such as a liquid or a gas, for example cooling water or cooling air, is supplied to heat exchanger 74 via supply pipe 76. The cooling medium could be forwarded from a cooling medium source 78, which may, for example, be ambient air, a lake or the sea, a water tank of a district heating system, etc. Hence, heat exchanger 74 may be a gas-liquid heat exchanger, if the cooling medium is a liquid, or a gas-gas heat exchanger if the cooling medium is a gas. The cooling medium could, for example, be circulated through heat exchanger 74 in a direction counter-current, co-current, or cross-current with respect to the flow of effluent gases passing therethrough. Often it is preferable to circulate the cooling medium through heat exchanger 74 counter-current to the effluent gases to obtain the greatest heat transfer to the cooling medium prior to the effluent gases exiting heat exchanger 74. Typically, cooling medium has a temperature of 40° to 100° C. As an alternative, if cooling medium is indoor air from cell room 12, the cooling medium will typically have a temperature about 10° C. above the temperature of ambient air. The effluent gases drawn from interior area 36*a* via suction duct 38 may typically have a temperature of 90° to 200° C., but the temperature may also be as high as 300° C., or even higher. In heat exchanger 74, effluent gases are cooled to a temperature of, typically, 70° to 130° C. to produce cool gases. As the effluent gases are cooled, the temperature of the cooling medium increases to, typically, 60° to 110° C., or even higher. Hence, heated cooling medium having a temperature of 60° to 110° C., or even up to 270° C. for example, leaves heat exchanger 74 via pipe 80. The cooling medium leaving via pipe 80 could be forwarded to a cooling medium recipient 82, for example, ambient air, a lake or the sea, a water tank of a district heating system, etc. Heated cooling medium may then be circulated to and utilized in other parts of the process, for example in regenerator 68, described hereinbefore. Heated cooling medium may also be utilized in other manners, such as for example, in the production of district heating water, in district cooling systems using hot water to drive absorption chillers, or as a heat source for desalination plants as described in patent application WO 2008/113496.

A return duct 84 is fluidly connected to heat exchanger 74. The return duct 84 returns cool gases to interior area 36*a* to cool hot spots in interior area 36*a* and production equipment in top 36*b* of hood 36. As such, cool gases circulate back to interior area 36*a* via supply ducts 88. Supply ducts 88 have distribution devices 90 to distribute cool gases in hot spots of interior area 36*a* and if desired, to create a suction in interior area 36*a* at openings 46. The suction in interior area 36*a* at openings 46 prevents or lessens effluent gas leakage from interior area 36*a*, which could be harmful to workers.

Distribution devices 90 are useful in the present embodiment for at least two different purposes. As noted above, one purpose is to reduce gas leakage from interior 36*a* of hood 36 at openings 46. As such, distribution devices 90 are useful to reduce gas leakage from hood 36 without requiring increased suction by fan 42. In prior art aluminium production plants, gas leakage can be reduced by either increasing the fan suction which increases the volume of gas to be treated in a gas treatment unit, or by reducing the size of openings through which gas leakage occurs. The openings through which gas leakage occurs are unavoidable due to gaps between lids in the hood and between anode studs and the hood. Such gaps or openings are therefore minimized already, and are difficult to reduce further.

Distribution devices 90 reduce gas leakage through a totally new approach to the problem. One mechanism by which distribution devices 90 reduce gas leakage is that the cool/cooler gas distributed by distribution devices 90 reduces the "buoyant effect" of the hot gas in interior area 36*a* of hood 36. The "buoyant effect" of hot gas refers to the fact that hot gas is less dense and thereby more buoyant than cooler gas. The buoyancy of the hot gas is responsible for most gas leakages through openings 46 in the top 36*b* of hood 36. Distribution devices 90 are positioned in interior area 36*a* of hood 36 to distribute cool/cooler gas to the top 36*b* of hood 36 thereby creating a mixture of cool/cooler gas with the hot gas in the top 36*b* of hood 36. This mixing results in a more moderate temperature gradient throughout interior area 36*a* rather than a temperature gradient where hot gas is at the top 36*b* of interior area 36*a* and more dense gas is below.

Figure 3:
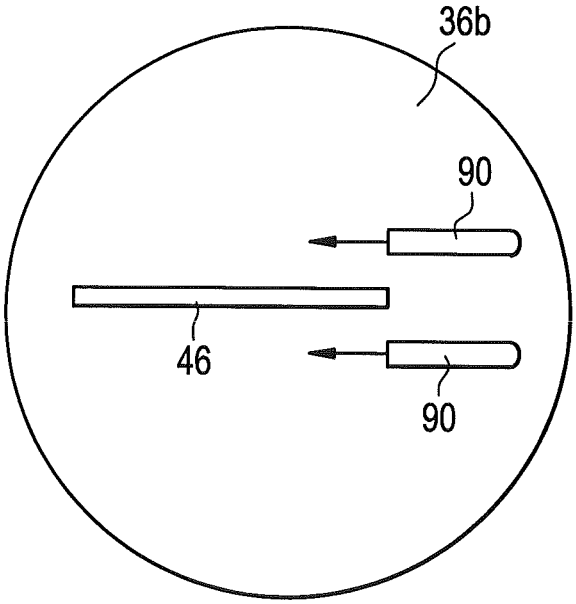
FIG. 3 is a schematic bottom view of a portion the top of the hood cut away from FIG. 2.
Figure 4:
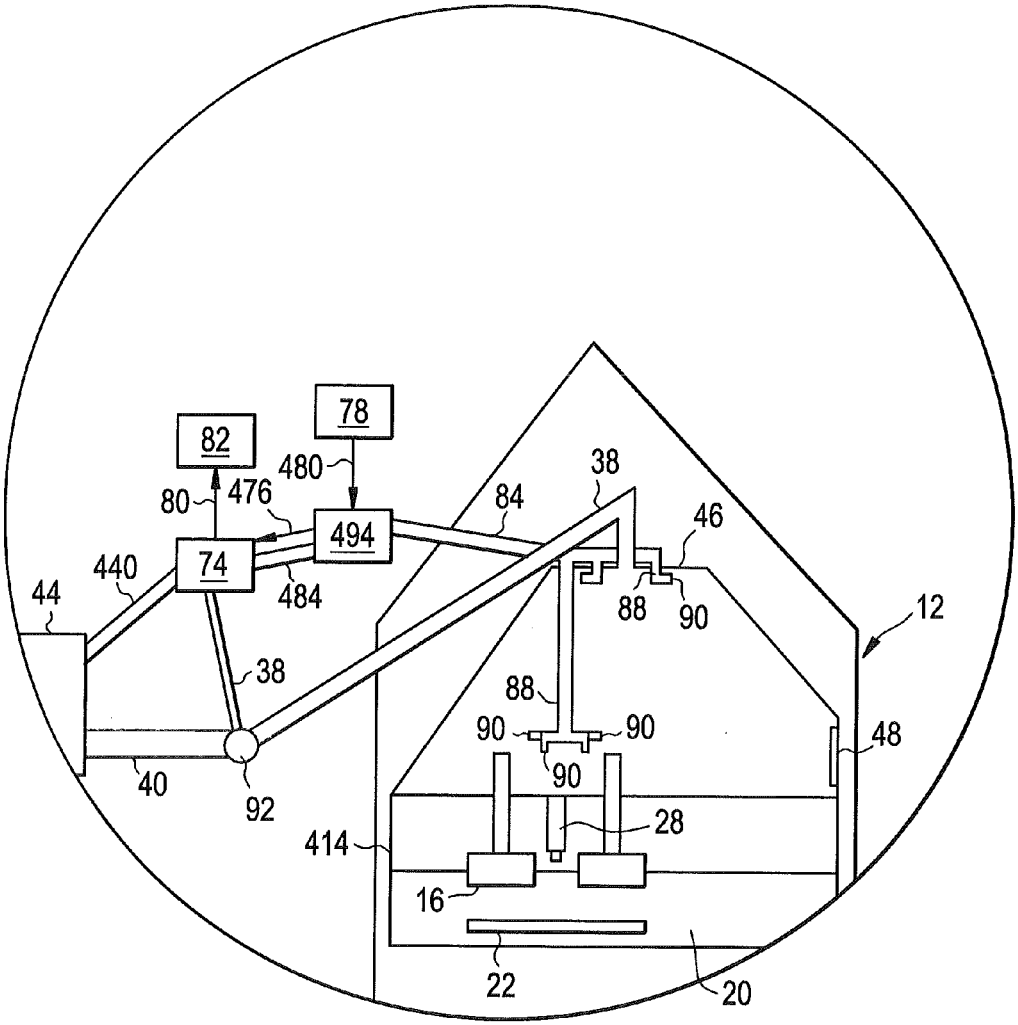

A second mechanism by which distribution devices 90 reduce gas leakage is that the cool/cooler gas distributed by distribution devices 90 is introduced as high velocity jets at specific locations with regard to openings 46 to create local areas of suction to reduce overpressures that cause gas leakages at openings 46. As illustrated in FIG. 3, distribution devices 90 are used to distribute cool/cooler gas as high velocity jets flowing parallel to openings 46 thus creating a local suction of gas away from openings 46 thus balancing overpressures at openings 46. For this purpose, cool/cooler gas distributed by distribution devices 90 is at a velocity of approximately 10 to 15 meters/second.

Distribution devices 90 are also useful in the present embodiment for another purpose, to cool interior area 36*a* of hood 36. Distribution devices 90 can be positioned within interior area 36*a* to distribute cool/cooler gas at specific locations on the superstructure 26 to reduce temperatures in unwanted "hot spots". One reason for cooling unwanted hot spots is to control the dimensional stability of the superstructure 26 or to protect sensitive equipment such as the feeders 28, as illustrated in FIG. 1. Electrolytic cell 14 cooling may also be necessary or desirable using distribution devices 90 since a trend in the aluminium production industry is to larger more energy intensive baths 20 that tend to be hotter than those used previously. At some point, cooling of the surface 18*a* of contents 18 in bath 20 may be necessary, such as in the case of temperatures above 300° C.

Distribution devices 90 are also useful in the present embodiment for another purpose, to provide an additional method for independent control of the heat balance of bath 20. Such is particularly beneficial in combination with power modulation, where power to the bath 20 is reduced when power demand on the grid and the cost of electricity is high.

Additional beneficial purposes for distribution devices 90 include enabling a reduction in size/volume capacity of an associated gas treatment unit 44 and enabling heat recovery, as noted previously.

Equipment within electrolytic cell 14, especially that located in top 36*b* of interior area 36*a*, requires protection from exposure to very hot gases. To obtain safe operation and long service life of such equipment, temperatures in top 36*b* of interior area 36*a* should preferably be less than about 200° C. to 250° C. to avoid or minimize too high of equipment heat loads. Furthermore, the effluent gases generated in the aluminium production process are hot and tend to accumulate under top 36*b* of hood 36. With very high temperatures at top 36*b*, the risk of leakage of such accumulated effluent gases increases. By supplying cool/cooler gases via distribution devices 90 to top 36*b*, gases in top 36*b* are cooled. Such cooling reduces the risks of equipment failure within electrolytic cell 14 due to excessive temperatures and reduces leakage of accumulated hot effluent gases, which may harm employees.

As noted briefly previously, cool/cooler gases distributed in top 36*b* via distribution devices 90 serve to alter the temperature and pressure profile within electrolytic cell 14. As such, the temperature and pressure profile of the subject embodiment has lower temperatures (more dense/higher pressure) at top 36*b* and increasing temperatures (less dense/lower pressure) toward the aluminium oxide feed ports 32 at bath 20 as illustrated in FIG. 1. Such a temperature and pressure profile is beneficial for the life of the equipment within electrolytic cell 14 and differs significantly from production methods and systems of the prior art where temperatures are higher at the top.

Cool/cooler gases from distribution devices 90 cool interior area 36*a*. Cool/cooler gases for purposes of cooling reduce or replace the use of ambient indoor air for cooling. Hence, ambient indoor air is not purposefully drawn into interior area 36*a* via openings 46 to the same extent as is the case for prior art, to cool electrolytic cells 14. Still further, the distribution of at least a portion of the effluent gases from interior area 36*a* back to interior area 36*a* via distribution devices 90 as cool/cooler gases results in an increased concentration of pollutants in the gases, such as hydrogen fluoride, sulphur dioxide, carbon dioxide, and dust particles. Typically, about 10% to about 80% of a total quantity of effluent gases drawn from interior area 36*a* are circulated back to interior area 36*a* after being cooled in the heat exchanger 74 to obtain cool gases. As a consequence, the total flow of gases cleaned in gas treatment unit 44 is reduced compared to that of the prior art method and system. A reduced flow of gases to gas treatment unit 44 is an advantage since gas treatment unit 44 thereby has lower capacity requirements measured in $m^3/h$ of gases. As such, the required capital investment and the ongoing operating costs associated with gas treatment unit 44 are each reduced. Another advantage of reducing the amount of ambient indoor air drawn into interior area 36*a* for purposes of cooling the same, is a reduction in the quantity of moisture transported with the gases through the gas treatment unit 44. Such moisture originates mainly from moisture in the ambient air. The quantity of moisture, measured in kg/h, carried through gas treatment unit 44 has a large influence on the formation of hard grade scale and crust on gas treatment unit 44 components, such as contact reactors 50 and fabric filters 54, in contact with the gases. By reducing the quantity of moisture carried through gas treatment unit 44, maintenance and operating costs associated with scale and crust formation within gas treatment unit 44 may be reduced. Still further, optional carbon dioxide removal device 60 can also be of a lower capacity design based on the reduced gas flow thus decreasing costs associated therewith. Gas treatment unit 44 is useful in cleaning gases having relatively high concentrations of hydrogen fluoride gas and sulphur dioxide gas. Higher concentrations of such pollutant gases make the cleaning process of the gas treatment unit 44 more efficient. This is also true of carbon dioxide removal device 60. Carbon dioxide removal device 60 is useful in treating gases having a relatively high concentration of carbon dioxide, thus making absorber 62 work more efficiently.

Optionally, a dust removal device 92 may be positioned within the suction duct 38 upstream of heat exchanger 74. Dust removal device 92 may, for example, be a fabric filter, a cyclone or a similar dust removal device useful in removing at least a portion of the dust particles entrained with the gases, before the gases flow into heat exchanger 74. The dust removal device 92 reduces the risk of dust particles clogging heat exchanger 74, and also reduces the risk of abrasion caused by dust particles in heat exchanger 74, and the like.

FIG. 4 is a schematic side view of a portion of the aluminium production plant 10 of FIG. 1 according to a second embodiment. Many of the features of the aluminium production plant of FIG. 4 are similar to those features of FIG. 1, and those features have been given the same reference numerals.

Referring now to FIG. 4, a suction duct 38 is fluidly connected to interior area 36*a* via hood 36 to draw effluent gases from interior area 36*a*. Heat exchanger 74 is arranged within duct 38 just downstream of hood 36. A cooling medium, such as cooling water or cooling air, is supplied to heat exchanger 74 via supply pipe 476, to cool gases in a similar manner as disclosed hereinbefore with reference to FIG. 1. Spent cooling medium exits heat exchanger 74 via pipe 80.

According to the subject embodiment, downstream of first heat exchanger 74 is a second heat exchanger 494 arranged in fluid connection with return duct 84. A cooling medium in the form of a cooling fluid, such as cooling water or cooling air, is supplied from a cooling medium source 78 to second heat exchanger 494 via a first pipe 480. Partially spent cooling fluid exits second heat exchanger 494 and is supplied to first heat exchanger 74 via supply pipe 476. Spent cooling fluid exits first heat exchanger 74 via pipe 80. Pipe 80 is fluidly connected to a cooling medium recipient 82, for example, ambient air, a lake or the sea, a water tank of a district heating system, etc.

Return duct 84 fluidly connected to second heat exchanger 494 is fluidly connected to supply duct 88. Supply duct 88 is arranged inside interior area 36*a*. Supply duct 88 is equipped with distribution devices 90 to distribute cooled gases in interior area 36*a*.

Hence, according to the embodiment illustrated in FIG. 4, at least a portion of the gases drawn from interior area 36*a* is cooled and circulated back to interior area 36*a*. The cooled gases are cooled in at least one of two stages. Firstly in the first heat exchanger 74 at least a portion of the gases drawn from interior area 36*a* is cooled. A portion of the cooled gases from first heat exchanger 74 may optionally be transported to gas treatment unit 44 via duct 440 without further cooling. At least a portion of the cooled gases from first heat exchanger 74 is transported to second heat exchanger 494 via duct 484. Second heat exchanger 494 further cools the cooled gases from first heat exchanger 74. The further cooled gases then flow from second heat exchanger 494 via return duct 84. Typically the cooling fluid supplied via pipe 480 to second heat exchanger 494 may have a temperature of about 40° to about 80° C. The partly spent cooling fluid that exits second heat exchanger 494 via pipe 476 may typically have a temperature of about 60° to about 100° C. The spent cooling fluid that exits first heat exchanger 74 via pipe 80 may typically have a temperature of about 80° to about 180° C., or even as high as 270° C., or even higher. Effluent gases drawn from interior area 36*a* via suction duct 38 typically have a temperature of about 90° to about 200° C., or even higher. In first heat exchanger 74 gases are cooled to a temperature of, typically, about 70° to about 130° C., i.e., cool gases. Gases to be circulated via supply duct 88 to interior area 36*a* are typically cooled further in second heat exchanger 494, to a temperature of typically about 50° to about 110° C., i.e., cooler gases. As an optional alternative, cool gases and/or cooler gases could circulate through a gas treatment unit 44 to remove at least some hydrogen fluoride, or other pollutants from the gases before circulation or return to the interior area 36*a*.

In comparison to the electrolytic cell 14 disclosed hereinbefore with reference to FIG. 1, electrolytic cell 414 increases heat transfer to the cooling fluid, since heat exchangers 74, 494 are positioned in series with respect to cooling fluid flow and gas flow, and the cooling fluid and the gas to be cooled flow counter-current with respect to one another. Increased heat transfer to cooling fluid increases the value of the cooling fluid. Furthermore, the fact that the cooled gases are cooled to a lower temperature, as compared to the embodiment described hereinbefore with reference to FIG. 1. Circulation and use of cooled gases rather than use of added, diluting, ambient air leads to a lower volume flow of gases to be cleaned by gas treatment unit 44 and carbon dioxide removal device 60, resulting in decreased equipment capacity requirements and investment costs.

As an alternative to arranging two heat exchangers 74, 494, in series with respect to the flow of the cooling fluid and cooled gases, two heat exchangers, 74, 494, could each operate independently of each other with respect to the cooling fluid. Each heat exchanger could even operate with a different type of cooling fluid.

To summarize, aluminium production electrolytic cell 14 comprises a bath 20 with contents 18, at least one cathode electrode 22 in contact with contents 18, at least one anode electrode 16 in contact with contents 18, and a hood 36, defining interior area 36*a*, covering at least a portion of said bath 20. A suction duct 38 is fluidly connected to interior area 36*a* for removing effluent gases from interior area 36*a*. Electrolytic cell 14 comprises at least one heat exchanger 74 for cooling at least a portion of the gases drawn from interior area 36*a* via duct 38, and at least one return duct 84 for circulation of at least a portion of the cooled gases, cooled by heat exchanger 74, to interior area 36*a* via distribution devices 90.

While the present invention has been described with reference to a number of preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. A method of ventilating an aluminium production electrolytic cell comprising:

drawing gases from an interior area of an electrolytic cell hood;

cooling at least a portion of said gases to form cool gases; and circulating at least a portion of said cool gases to the interior area through one or more distribution devices, wherein the cool gases are circulated via the at least one distribution device to the interior area creating a local suction at openings of the electrolytic cell hood to counteract leakages.

2. A method according to claim 1, further comprising circulating 10% to 80% of a total volume of gases drawn from the interior area back to the interior area after cooling.

3. A method according to claim 1, further comprising cooling the full volume of gases drawn from the interior area using a first heat exchanger, drawing from the first heat exchanger a portion of cooled gases, circulating at least a portion of said portion of cooled gases to a second heat exchanger for further cooling of gases to obtain cooler gases, and circulating at least a portion of said cooler gases to the interior area through distribution devices.

4. A method according to claim 3, wherein a cooling fluid is first passed through the second heat exchanger and then passed through the first heat exchanger.

5. A method according to claim 3, wherein said cooled gases or said cooler gases first circulate through a gas treatment unit to remove at least some hydrogen fluoride gas from the gases before circulation to the interior area.

6. A method according to claim 3, wherein at least a portion of said cooled gases or said cooler gases is distributed by at least one distribution device to feeders within said electrolytic cell.

7. A method according to claim 3, wherein at least a portion of said cooled gases or said cooler gases is circulated to a top of the interior area.

8. A method according to claim 3, wherein at least a portion of dust particles entrained by gases drawn from the interior area is removed from said gases prior to cooling said gases.

9. A method of claim 1, wherein at least one opening is associated with a side wall door that connects the interior area of the electrolytic cell hood with an environment outside of the cell.

10. An aluminium production electrolytic cell comprising:

a bath with contents;

at least one cathode electrode in contact with said contents;

at least one anode electrode in contact with said contents;

a hood defining an interior area covering at least a portion of said bath;

a suction duct fluidly connected to the interior area to draw effluent gases from said interior area and into at least one heat exchanger for cooling at least a portion of the gases; and at least one return duct for circulating at least a portion of the gases cooled by the heat exchanger to the interior area through at least one distribution device, wherein the at least one distribution device is used to circulate cooled gases to the interior area creating a local suction at openings of the electrolytic cell hood to counteract leakages.

11. An aluminium production electrolytic cell according to claim 10, wherein said heat exchanger is a first heat exchanger for cooling gases drawn from the interior area, and a second heat exchanger arranged for further cooling of gases then circulated to the interior area through at least one distribution device.

12. An aluminium production electrolytic cell according to claim 11, wherein a first pipe is arranged for forwarding a cooling medium to the second heat exchanger, a second pipe is arranged for forwarding the cooling medium from the second heat exchanger to the first heat exchanger, and a third pipe is arranged for disposal of cooling medium from the first heat exchanger.

13. An aluminium production electrolytic cell according to claim 10, wherein said at least one distribution device for circulating cooled gases to interior area is arranged in a top of the interior area.

14. An aluminium production electrolytic cell according to claim 10, wherein a dust removal device is arranged upstream of the at least one heat exchanger for removing at least a portion of the dust particles of the gases prior to cooling said gases in the at least one heat exchanger.

15. An aluminium production electrolytic cell according to claim 10, wherein said at least one distribution device circulates cooled gases to the interior area altering a temperature and pressure profile within the interior area.

16. An aluminium production electrolytic cell according to claim 10, wherein at least one opening is associated with a side wall door that connects the interior area of the electrolytic cell hood with an environment outside of the cell.

* * * * *